US007338387B2

(12) United States Patent
Nycum et al.

(10) Patent No.: US 7,338,387 B2
(45) Date of Patent: Mar. 4, 2008

(54) IRON GOLF CLUB

(75) Inventors: James A. Nycum, San Marcos, CA (US); Chris J. Wieland, Vista, CA (US); James C. Wenck, Carlsbad, CA (US); Roger Cleveland, Los Angeles, CA (US); Herbert Reyes, Laguna Niguel, CA (US); Uday V. Deshmukh, Carlsbad, CA (US); Karl A. Clausen, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 3 days.

(21) Appl. No.: 11/274,733

(22) Filed: Nov. 14, 2005

(65) Prior Publication Data

US 2006/0084527 A1 Apr. 20, 2006

Related U.S. Application Data

(60) Continuation-in-part of application No. 10/904,816, filed on Nov. 30, 2004, now Pat. No. 7,112,148, which is a division of application No. 10/604,518, filed on Jul. 28, 2003, now Pat. No. 7,004,853.

(51) Int. Cl.
*A63B 53/04* (2006.01)

(52) U.S. Cl. ..... 473/332; 473/350

(58) Field of Classification Search ..... 473/338, 473/344, 349–350, 332
See application file for complete search history.

(56) References Cited

U.S. PATENT DOCUMENTS 4,420,156 A * 12/1983 Campau ..... 473/291
4,664,383 A 5/1987 Aizawa et al.
4,667,963 A 5/1987 Yoneyama
4,708,347 A * 11/1987 Kobayashi ..... 473/338
4,792,139 A 12/1988 Nagasaki et al.
4,798,383 A 1/1989 Nagasaki et al.
4,848,747 A 7/1989 Fukimura et al.
4,884,812 A 12/1989 Nagasaki et al.
4,928,972 A 5/1990 Nakanisi et al.
4,964,640 A 10/1990 Nakanisi et al.
5,120,062 A 6/1991 Scheie et al.
5,104,457 A * 4/1992 Viljoen et al. ..... 473/350
5,190,290 A 3/1993 Take
5,228,694 A 7/1993 Okumoto et al.
D347,254 S 5/1994 Iinuma
5,326,106 A 7/1994 Meyer
5,333,872 A 8/1994 Manning et al.

(Continued)

FOREIGN PATENT DOCUMENTS

JP 55-104451 * 8/1980

*Primary Examiner*—Stephen Blau
(74) *Attorney, Agent, or Firm*—Michael A. Catania; Elaine H. Lo

(57) ABSTRACT

The iron golf club head (20) of the present invention is preferably composed of three main components: a main body (22), a central member (24) and a mass member (25). The Mass member (25) is preferably composed of a high density material such as a nickel-tungsten alloy. The central member (24) is preferably composed of a lightweight, non-metal material. The main body (22) is preferably composed of a titanium alloy material. The iron golf club head (20) preferably has high moments of inertia Izz and Ixx, and a low center of gravity.

12 Claims, 8 Drawing Sheets

U.S. PATENT DOCUMENTS

| | | | | |
|---|---|---|---|---|
| D353,644 | S | 12/1994 | Hirsch | |
| 5,375,840 | A | 12/1994 | Hirsch et al. | |
| D354,786 | S | 1/1995 | Manning et al. | |
| 5,411,264 | A | 5/1995 | Oku | |
| 5,423,546 | A | 6/1995 | Manning et al. | |
| 5,472,201 | A | 12/1995 | Aizawa et al. | |
| D366,082 | S | 1/1996 | Dekura | |
| D368,756 | S | 4/1996 | Blough et al. | |
| D368,947 | S | 4/1996 | Blough et al. | |
| 5,547,194 | A | 8/1996 | Aizawa et al. | |
| 5,595,552 | A | 1/1997 | Wright et al. | |
| 5,628,698 | A * | 5/1997 | Sumitomo | 473/341 |
| 5,749,795 | A * | 5/1998 | Schmidt et al. | 473/350 |
| 6,179,726 | B1 * | 1/2001 | Satoh et al. | 473/290 |
| 6,277,326 | B1 | 8/2001 | Deshmukh et al. | |
| D464,387 | S | 10/2002 | Rollinson et al. | |
| D464,693 | S | 10/2002 | Rollinson et al. | |
| D474,822 | S | 5/2003 | Cleveland et al. | |
| 6,592,469 | B2 * | 7/2003 | Gilbert | 473/350 |
| 6,602,147 | B2 * | 8/2003 | Shiraishi | 473/291 |
| 6,638,183 | B2 * | 10/2003 | Takeda | 473/335 |
| 2006/0194641 | A1 * | 8/2006 | Best | 473/290 |

* cited by examiner

IRON GOLF CLUB

CROSS REFERENCES TO RELATED APPLICATIONS

The Present Application is a continuation-in-part application of U.S. patent application Ser. No. 10/904,816, filed on Nov. 30, 2004, now U.S. Pat. No. 7,112,148 which is a divisional application of U.S. patent application Ser. No. 10/604,518, filed on Jul. 28, 2003, now U.S. Pat. No. 7,004,853.

STATEMENT REGARDING FEDERALLY SPONSORED RESEARCH OR DEVELOPMENT

Not Applicable

BACKGROUND OF THE INVENTION

1. Field of the Invention

The present invention relates to an iron golf club. More specifically, the present invention relates to a multiple material iron golf club.

2. Description of the Related Art

Irons are typically composed of a stainless steel or titanium material, and are typically cast or forged. Most golfers desire that their irons have a large sweet spot for greater forgiveness, a low center of gravity to get the ball in the air, a solid sound, reduced vibrations during impact, and a trim top line for appearance. Unfortunately, these desires are often in conflict with each other as it pertains to an iron.

The use of iron club heads composed of different materials has allowed some prior art irons to achieve some of these desires.

One example is U.S. Pat. No. 5,228,694 to Okumoto et al., which discloses an iron club head composed of a stainless steel sole and hosel, a core composed of a bulk molding compound or the like, a weight composed of a tungsten and polyamide resin, and an outer-shell composed of a fiber-reinforced resin.

Another example is set forth in U.S. Pat. Nos. 4,792,139, 4,798,383, 4,792,139 and 4,884,812, all to Nagasaki et al., which disclose an iron club head composed of stainless steel with a fiber reinforced plastic back plate to allow for weight adjustment and ideal inertia moment adjustment.

Another example is U.S. Pat. No. 4,848,747 to Fujimura et al., which discloses a metal iron club head with a carbon fiber reinforced plastic back plate to increase the sweet spot. A ring is used to fix the position of the back plate.

Another example is set forth in U.S. Pat. Nos. 4,928,972 and 4,964,640 to Nakanishi et al., which disclose an iron club head composed of stainless steel with a fiber reinforcement in a rear recess to provide a dampening means for shock and vibrations, a means for increasing the inertial moment, a means for adjusting the center of gravity and a means for reinforcing the back plate.

Another example is U.S. Pat. No. 5,190,290 to Take, which discloses an iron club head with a metal body, a filling member composed of a light weight material such as a plastic, and a fiber-reinforced resin molded on the metal body and the filling member.

Another example is U.S. Pat. No. 5,411,264 to Oku, which discloses a metal body with a backwardly extended flange and an elastic fiber face plate in order to increase the moment of inertia and minimize head vibrations.

Another example is U.S. Pat. No. 5,472,201 to Aizawa et al., which discloses an iron club head with a body composed of stainless steel, a face member composed of a fiber reinforced resin and a protective layer composed of a metal, in order to provide a deep center of gravity and reduce shocks.

Another example is U.S. Pat. No. 5,326,106 to Meyer, which discloses an iron golf club head with a metal blade portion and hosel composed of a lightweight material such as a fiber reinforced resin.

Another example is U.S. Pat. No. 4,664,383 to Aizawa et al., which discloses an iron golf club head with a metal core covered with multiple layers of a reinforced synthetic resin in order to provide greater ball hitting distance.

Another example is U.S. Pat. No. 4,667,963 to Yoneyama, which discloses an iron golf club head with a metal sole and a filling member composed of a fiber reinforced resins material in order to provide greater hitting distance.

The prior art fails to disclose an iron golf club head that is composed of multiple materials, has a low center of gravity, reduced vibrations, and a greater moment of inertia.

BRIEF SUMMARY OF THE INVENTION

The present invention provides an iron golf club head which has a low center of gravity, a high moment of inertia, reduced vibrations and a solid feel and appearance. The present invention is able to provide these features through use of a multiple material iron club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
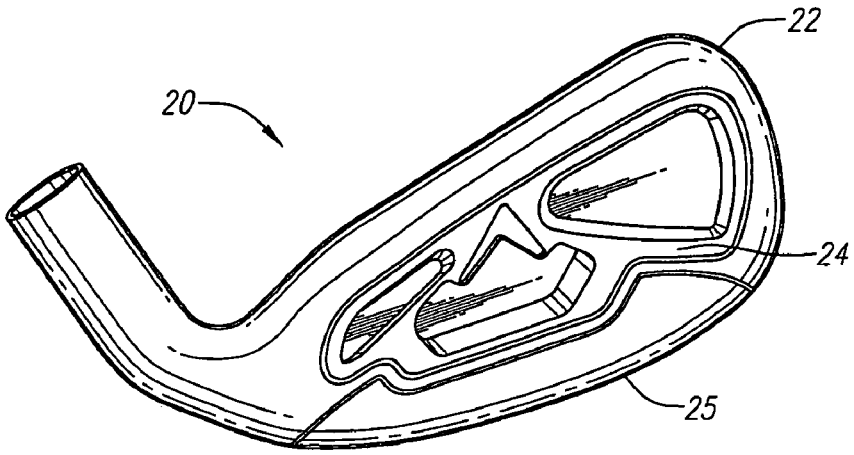
FIG. 1 is a top perspective view of an iron club head of a preferred embodiment of the present invention.
Figure 2:
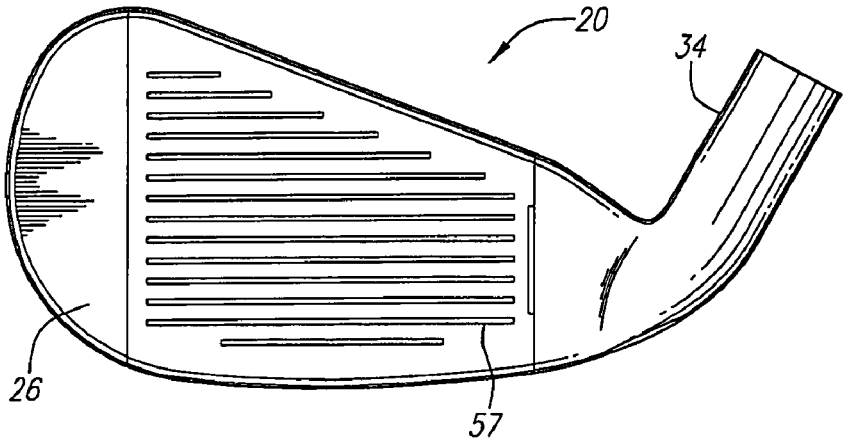
FIG. 2 is a front plan view of an iron club head.
Figure 3:
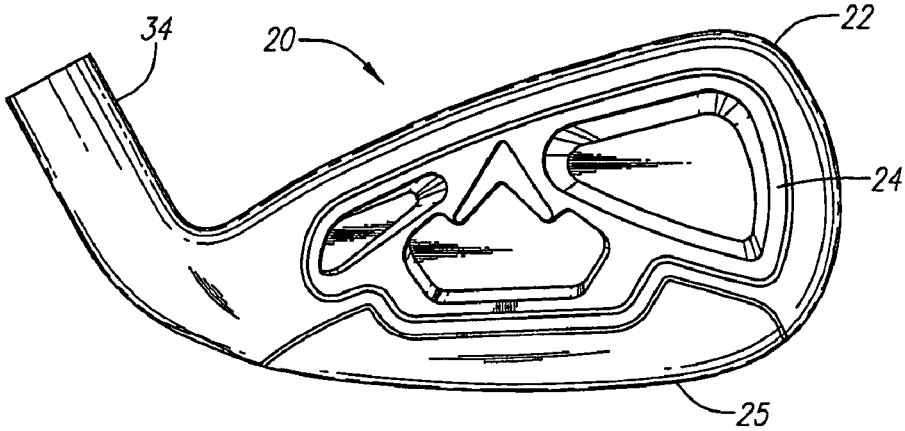
FIG. 3 is a rear plan view of an iron club head.
Figure 4:
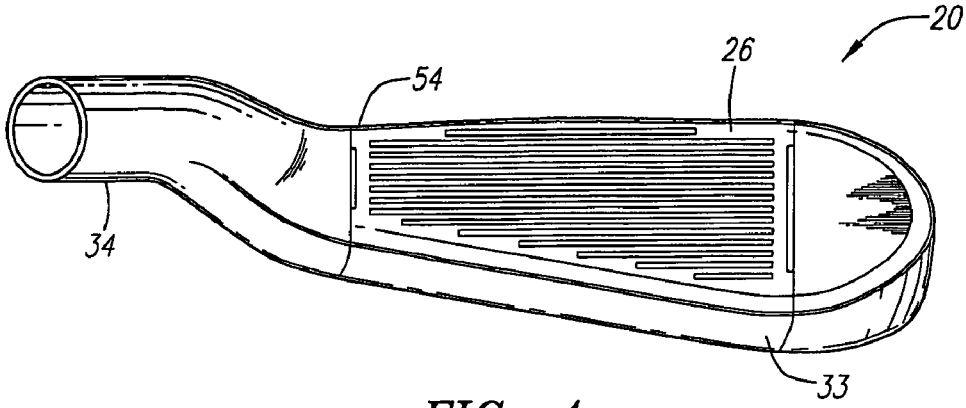
FIG. 4 is a top plan view of an iron club head.

As shown in FIGS. 1-12, an iron-type golf club head in accordance with the present invention is generally designated 20. The club head 20 is preferably composed of three main components: a main body 22, a central member 24 and a mass member 25. The club head 20 can range from a 1-iron to a lob-wedge, with the loft angle preferably ranging from fifteen degrees to sixty degrees, and a lie angle preferably ranging from fifty-nine to sixty-five degrees.

The mass member 25 is preferably composed of a material having a density greater than 8.0 grams per cubic centimeter ("g/cm$^3$"). A preferred material is an iron-nickel-tungsten alloy having a density preferably ranging from 8.0 g/cm$^3$ to 12.0 g/cm$^3$, more preferably ranging from 9.0 g/cm$^3$ to 10.5 g/cm$^3$, most preferably 9.3 g/cm$^3$. Another preferred material is a nickel-tungsten alloy disclosed in co-pending U.S. patent application Ser. No. 10/604,518, filed on an even date herewith, entitled High Density Alloy for Improved Mass Properties of an Article, which is hereby incorporated by reference in its entirety. The preferred nickel-tungsten alloy includes at least 50 weight percent nickel, at least 20 weight percent tungsten and at least 20 weight percent chromium and has a density in the range of 9.0 g/cm$^3$ to 10.5 g/cm$^3$. Another alternative material is a stainless steel material. Still another material is disclosed in U.S. Pat. No. 6,277,326, entitled Process for Liquid-Phase Sintering of a Multiple-Component Material, which is hereby incorporated by reference in its entirety. Those skilled in the pertinent art will recognize that still other materials may be used for the mass member 25 without departing from the scope and spirit of the present invention. A preferred method for forming the mass member 25 is through investment casting.

The main body 22 has a front wall 26, a sole wall 28, a toe wall 30, a heel wall 32, a top wall 33, and a hosel 34 preferably with a bore 36 for receiving a shaft. The front wall 26, the top wall 33, the sole wall 28, the toe wall 30 and the heel wall 32 define a rear cavity 37 of the main body portion 22. The bore 36 preferably extends through the entire hosel 34 providing a short straight hollow hosel such as disclosed in U.S. Pat. No. 4,995,609, which pertinent parts are hereby incorporated by reference.

Figure 5:
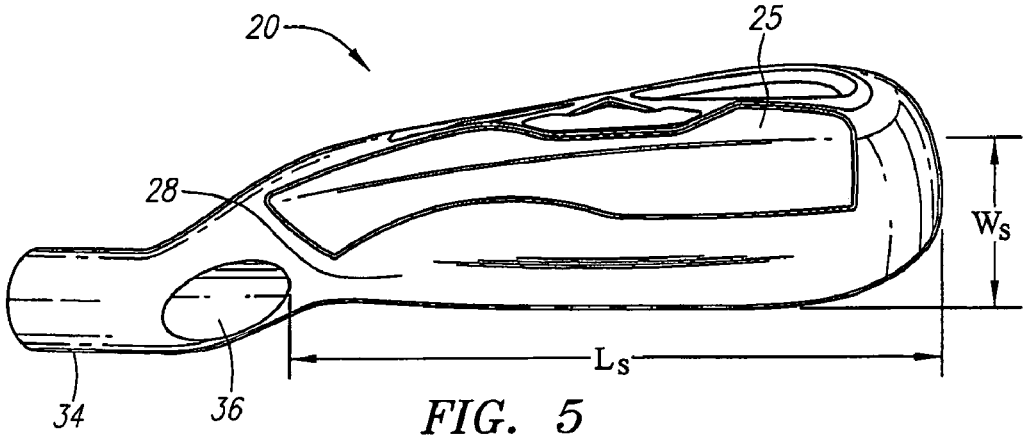
FIG. 5 is a bottom plan view of an iron club head.
Figure 6:
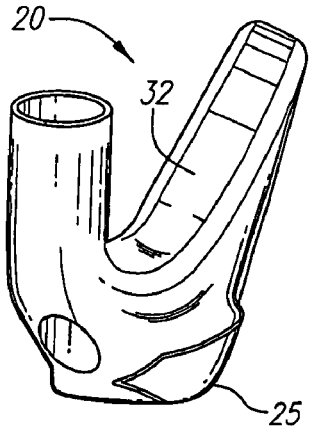
FIG. 6 is a heel side view of an iron club head.
Figure 14:
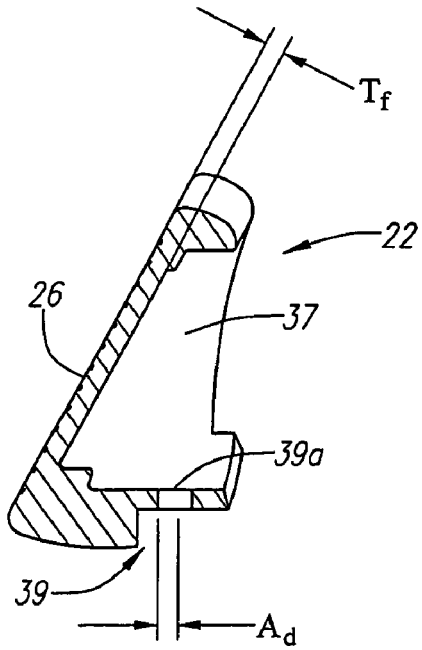
FIG. 14 is a cross-sectional view along lines 14-14 of FIG. 13.

The sole wall 28 preferably has a cambered exterior surface, which contacts the ground during a golf swing. As shown in FIG. 5, the sole wall 28 has a width, "$W_S$", that preferably ranges from 1.00 inch to 1.75 inch, and is most preferably 1.25 inch. The sole wall 28 also has a length, "$L_S$", from a toe end to the beginning of the bore 36, which preferably ranges from 2.5 inches to 3.5 inches, and is most preferably 3.0 inches. As shown in FIG. 14, the sole wall 28 has a recess 39 with an aperture 39*a* for placement of the mass member 25 therein. The aperture 39*a* preferably has a diameter, "$A_d$", that preferably ranges from 0.05 inch to 0.250 inch, and more preferably from 0.150 inch to 0.200 inch. The size of the recess 39 varies from 1-iron to lob-wedge with a lob-wedge having the largest mass member 25 and the 1-iron having the smallest mass member 25. The recess 39 preferably has a volume capacity that is slight larger than the volume of the mass member 25. The volume capacity of the recess 39 is preferably larger to accommodate the epoxy adhesive used to adhere the mass member 25 to the main body 22.

Figure 7:
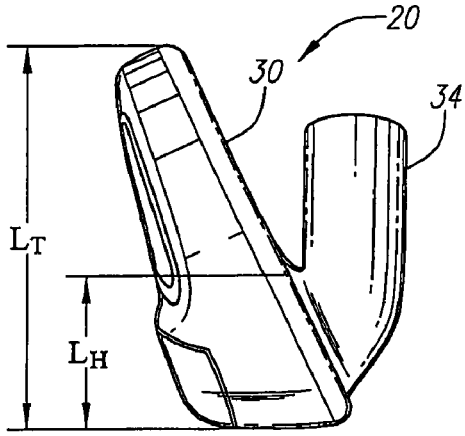
FIG. 7 is a toe side view of an iron club head.
Figure 8:
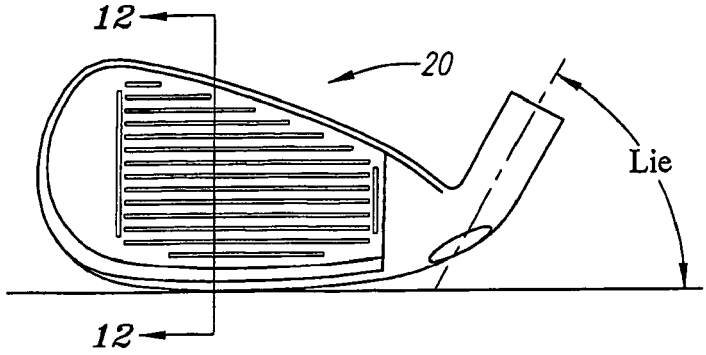
FIG. 8 is a front plan view of a 5-iron club head illustrating the lie angle of the club head.
Figure 9:
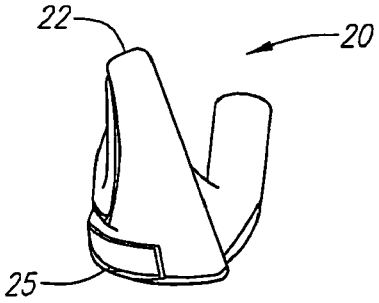
FIG. 9 is a toe side view of a 5-iron club head.
Figure 10:
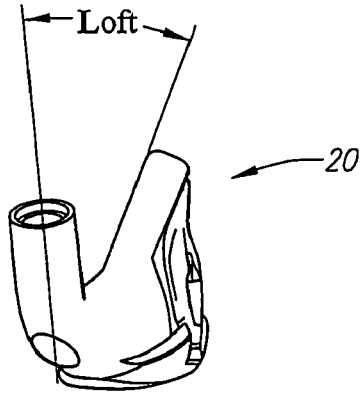
FIG. 10 is a heel side view of a 5-iron illustrating the loft angle of the club head.
Figure 11:
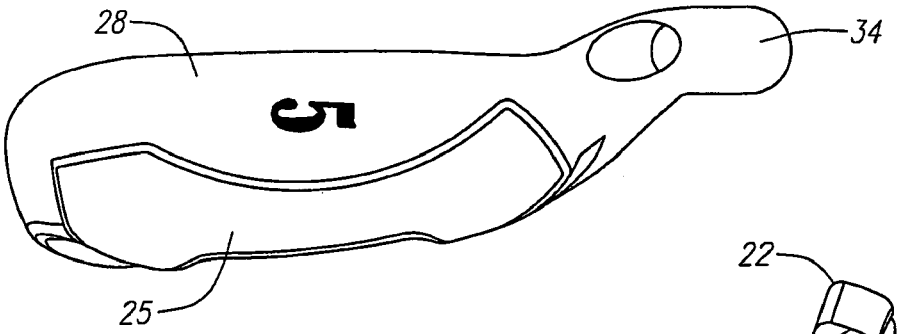
FIG. 11 is a bottom plan view of a 5-iron.
Figure 12:
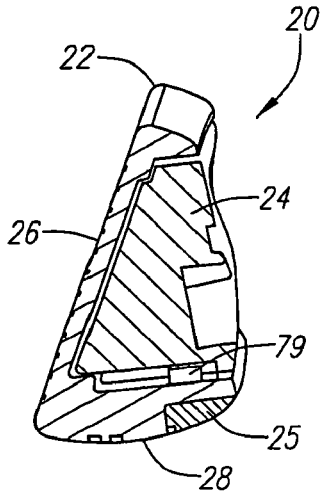
FIG. 12 is a cross-sectional view along lines 12-12 of the 5-iron club head of FIG. 8.
Figure 13:
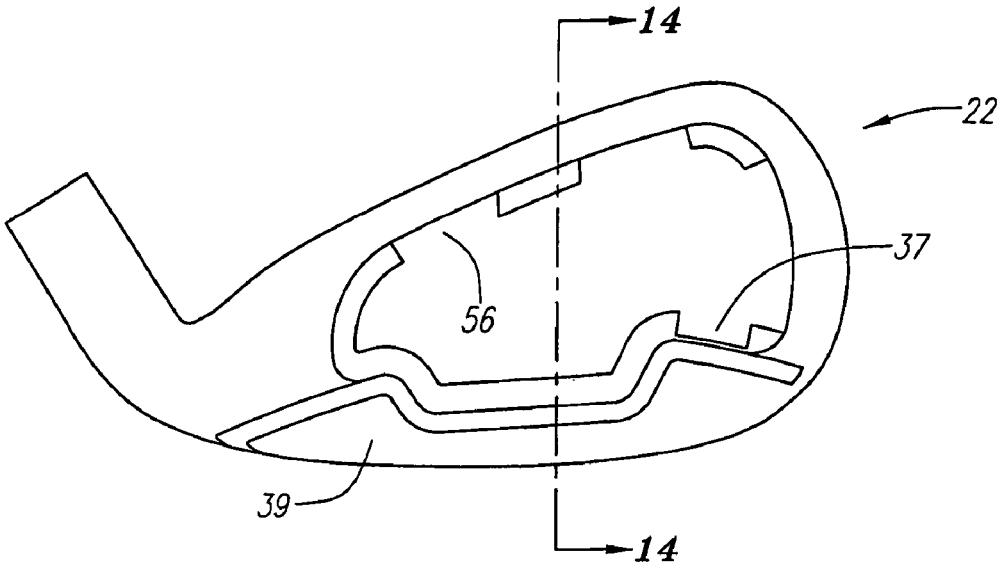
FIG. 13 is an isolated rear plan view of a preferred embodiment of a main body portion of the iron club head of the present invention.

As shown in FIG. 7, the toe wall 30 preferably has a length, "$L_T$", which preferably ranges from 1.5 inches to 2.5 inches, and is most preferably 2.0 inches. The toe wall 30 preferably has a width that tapers from a lower end to an upper end of the toe wall 30.

As shown in FIG. 7, the heel wall 32 preferably has a length, "$L_H$", which preferably ranges from 0.5 inch to 1.5 inches, and is most preferably 1.0 inch. The heel wall 32 preferably has a width that tapers from a lower end to an upper end of the heel wall 32.

The front wall 26 has an interior surface 56, which preferably engages the interior surface 42 of the central member 24 or an adhesive placed on the interior surface 42 of the central member 24, and an exterior surface 54 which preferably has scorelines 57 thereon. As shown in FIG. 14, the front wall 26 preferably has a thickness, "$T_f$", that ranges from 0.040 inch to 0.250 inch, more preferably from 0.075 inch to 0.160 inch, and most preferably 0.112 inch. The main body 22 is preferably composed of a lightweight material such as titanium materials, stainless steel, amorphous metals and the like. The material of the main body 22 preferably has a density between 4 g/cm$^3$ and 9 g/cm$^3$. Such titanium materials include pure titanium and titanium alloys such as 6-4 titanium alloy, 6-22-22 titanium alloy, 4-2 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. The main body 22 is preferably manufactured through casting. Alternatively, the main body 22 is manufactured through forging, forming, machining, powdered metal forming, metal-injection-molding, electrochemical milling, and the like. The main body preferably has a volume ranging from 50% to 75% of the iron-type club head and a mass ranging from 50% to 75% of the iron-type club head.

Figure 15:
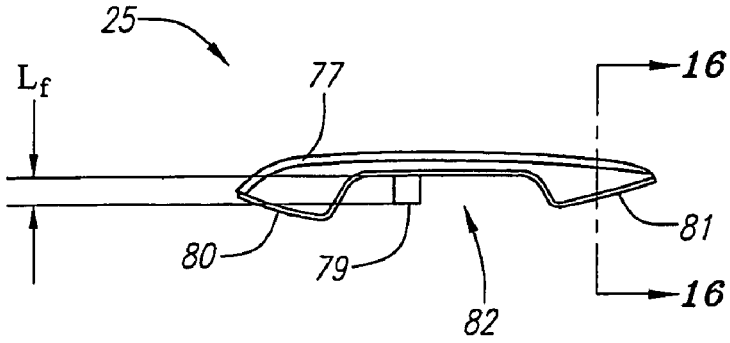
FIG. 15 is an isolated side view of a preferred embodiment of a mass member of the iron club head of the present invention.
Figure 16:
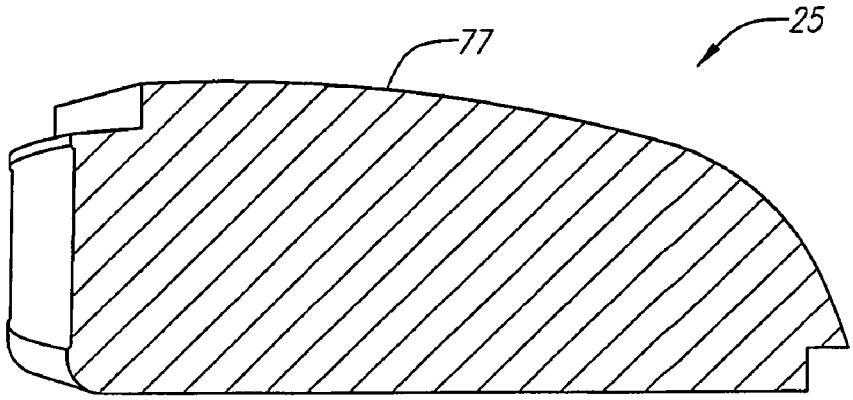
FIG. 16 is a cross-sectional view along lines 16-16 of FIG. 15.
Figure 17:
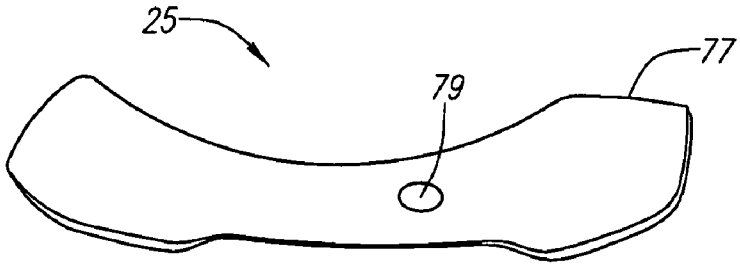
FIG. 17 is an isolated top view of a preferred embodiment of a mass member of the iron club head of the present invention.
Figure 18:
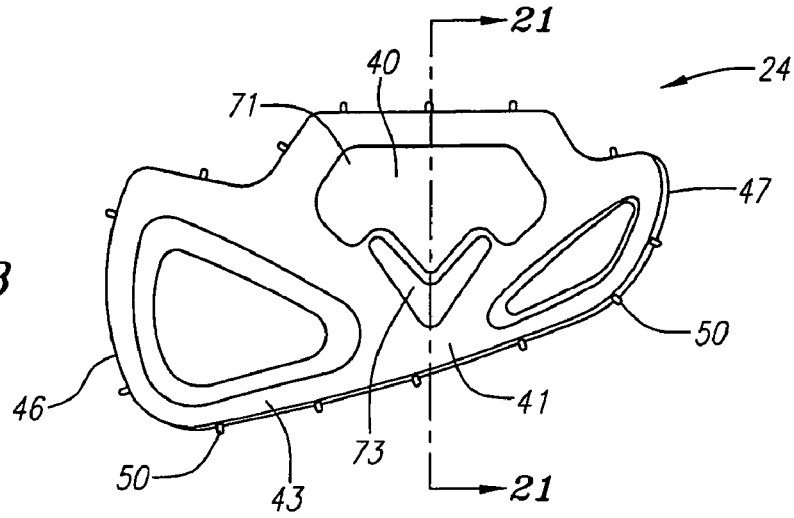
FIG. 18 is isolated front view of a preferred embodiment of a central member of an iron club head.
Figure 19:
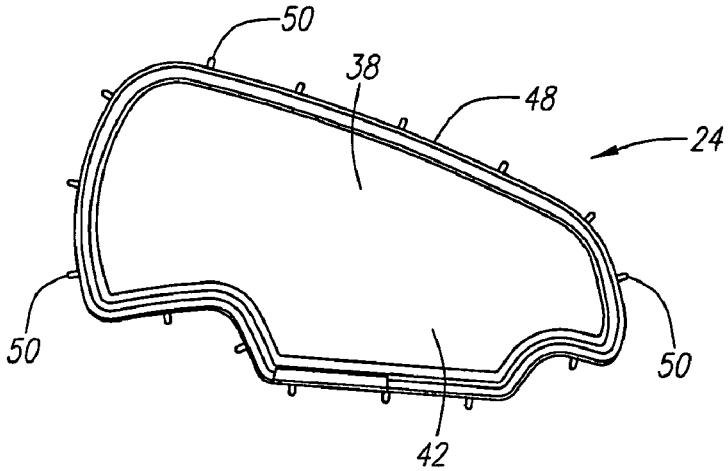
FIG. 19 is a rear plan view of the central member of FIG. 18.
Figure 20:
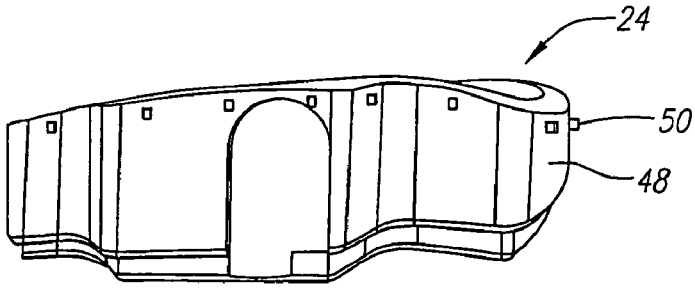
FIG. 20 is a bottom view of the central member of FIG. 18.
Figure 21:
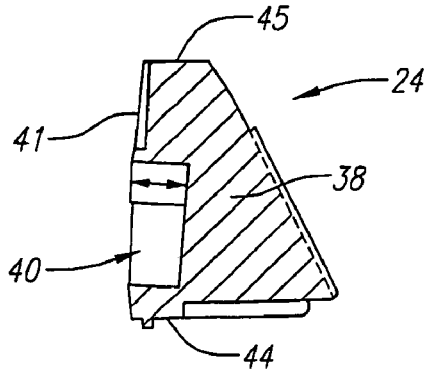
FIG. 21 is a cross-sectional view along lines 21-21 of FIG. 18.

As shown in FIGS. 15-17, the mass member 25 includes a body 77 and a projection 79. The body 77 has a first end 82 and a second 81 that are preferably shaped to form a notch 82 in the body 77. The projection 79 preferably has a length, "Lp", that ranges from 0.055 inch to 0.255 inch, and more preferably from 0.155 inch to 0.225 inch. The projection 79 is inserted into the aperture 39*a* of the sole wall 28 for securing the mass member 25 to the main body 22, and for proper placement of the mass member 25 within the recess 39 of the sole wall of the main body 22. In a preferred embodiment, the mass member 25 is secured within the recess 39 using an epoxy. Alternatively, the mass member 25 is press fitted within the recess 39. The mass member 25 preferably has a volume percentage of the golf club head 20 ranging from 5% to 25%, and a mass percentage of the golf club head 20 ranging from 10% to 50%. Mass attributable to the mass member 25 lowers the center of gravity of the club head 20 to promote a higher trajectory during ball striking thereby creating a more forgiving iron.

The central member 24 is composed of a non-metal material. The non-metal material of the central member preferably has a density less than 1.5 g/cm$^3$. Preferred materials include bulk molding compounds, sheet molding compounds, thermosetting materials and thermoplastic materials. A preferred bulk molding compound is a resinous material with reinforcement fibers. Such resins include polyesters, vinyl esters and epoxy. Such fibers include carbon fibers, fiberglass, aramid or combinations. A preferred sheet molding compound is similar to the bulk molding compounds, however, in a sheet form. A preferred thermoplastic material is a thermoplastic polyurethane. Other thermoplastic materials include polyesters, polyethylenes, polyamides, polypropylenes, and the like.

The central member 24 is primarily a support for the front wall 26, and thus the central member should be able to withstand impact forces without failure. The central member 24 also reduces vibrations of the golf club head 20 during ball striking. The central member 24 is preferably 25% to 75% of the volume of the club head 20 and preferably 10% to 30% of the mass of the club head 20.

The central member 24 preferably has a body portion 38, a first recess 40, a second recess 41, an interior surface 42, an exterior surface 43, a sole surface 44, a top surface 45, a toe surface 46, and a heel surface 47. The recesses 40 and 41 are formed in the exterior surface 43 of the body portion 38 and may have any of a number of suitable configurations. The body portion 38 preferably tapers upward from the sole surface 44. The body portion 38 also has a perimeter 48.

On the perimeter 48 is preferably a plurality of tabs 50 for positioning and retaining the central member 24 within the periphery member 22. Each of the plurality of tabs 50 is preferably curved portion. The curved portion engages with the interior surface of the main body 22. Each of the plurality of tabs 50 is compressible for engagement of the central member 24 with the main body 22, and the plurality of tabs 50 assist with the centering and alignment of the central member 24 within the rear cavity 37. An adhesive is preferably filled between the each of the plurality of tabs 50 for securing the central member 24 to the main body 22. A more thorough description of the plurality of tabs 50 is disclosed in Helmstetter et al., U.S. Pat. No. 6,238,302 for a Golf Club Head With An Insert Having Integral Tabs, assigned to Callaway Golf Company, and hereby incorporated by reference in its entirety.

A first medallion 71 is preferably placed within the first recess 40 and a second medallion 73 is preferably placed within the second recess 41. The first and second medallions 71 and 73 are preferably utilized for swing weighting of the golf club head 20. The mass each medallion 71 and 73 preferably varies from 0.5 gram to 7 grams.

The club head 20 preferably has a total volume that ranges from 40.0 cm$^3$ to 60.0 cm$^3$, more preferably from 45.0 cm$^3$ to 55.0 cm$^3$, and most preferably 50.8 cm$^3$ for a 5-iron golf club head 20. The club head 20 preferably has a mass that ranges from 235 grams to 300 grams, more preferably from 245 grams to 260 grams for a 5-iron golf club head 20.

The main body 22 preferably has a mass that ranges from 100 grams to 250 grams, more preferably from 150 grams to 200 grams. The central member 24 preferably has a mass that ranges from 5 grams to 40 grams, more preferably from 15 grams to 40 grams, and most preferably 18 grams. The mass member 25 preferably has a mass that ranges from 30 grams to 100 grams, more preferably from 40 grams to 80 grams, and more preferably 60 grams to 80 grams.

The axes of inertia through the center of gravity of the golf club head 20 are designated X, Y and Z. The X axis extends from the front of the golf club head 20 through the center of gravity, CG, at the front wall to the rear of the golf club head 20. The Y axis extends from the heel end of the golf club head 20 through the center of gravity, CG, and to the toe end of the golf club head 20. The Z axis extends from the sole wall through the center of gravity, CG, and to the top line of the golf club head 20.

As defined in *Golf Club Design, Fitting, Alteration & Repair,* 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2200 g-cm$^2$ to 3000 g-cm$^2$, more preferably from 2400 g-cm$^2$ to 2700 g-cm$^2$, and most preferably from 2472 g-cm$^2$ to 2617 g-cm$^2$. The moment of inertia, Iyy, about the Y-axis for the golf club head 20 preferably ranges from 400 g-cm$^2$ to 700 g-cm$^2$, more preferably from 500 g-cm$^2$ to 600 g-cm$^2$, and most preferably from 530 g-cm$^2$ to 560 g-cm$^2$. The moment of inertia, Ixx, about the X-axis for the golf club head 20 preferably ranges from 2450 g-cm$^2$ to 3200 g-cm$^2$, more preferably from 2500 g-cm$^2$ to 2900 g-cm$^2$, and most preferably from 2650 g-cm$^2$ to 2870 g-cm$^2$.

In general, the products of inertia, Iyz, Ixz and Ixy for the golf club head 20 preferably have an absolute value below 100 g-cm$^2$ for at least one and preferably two of the products of inertia Iyz, Ixz and Ixy. Products of inertia for a golf club head are disclosed in U.S. Pat. No. 6,547,676, entitled Golf Club Head That Optimizes Products Of Inertia, assigned to Callaway Golf Company, and hereby incorporated by reference in its entirety.

For comparison, the new BIG BERTHA® 5-iron from Callaway Golf Company has a moment of inertia, Izz, of 2158 g-cm$^2$, a moment of inertia, Iyy, of 585 g-cm$^2$, and a moment of inertia, Ixx, of 2407 g-cm$^2$.

Figure 22:
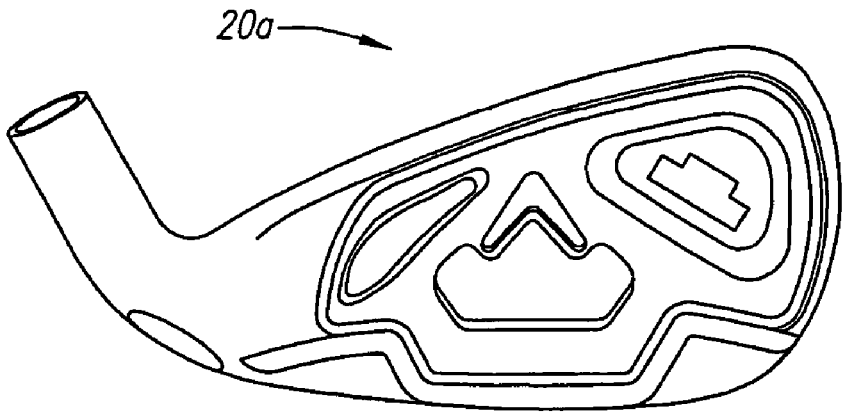
FIG. 22 is a rear plan view of a 2-iron club head.
Figure 23:
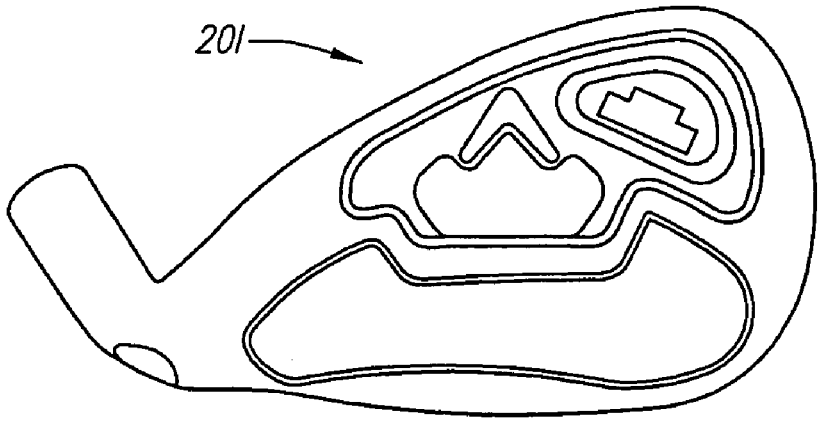
FIG. 23 is a rear plan view of a lob wedge iron club head.
Figure 24:
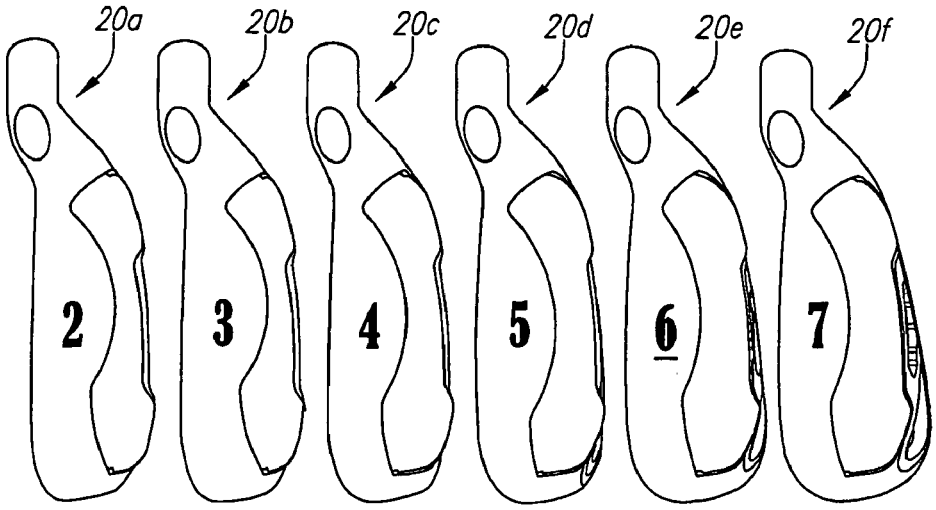
FIG. 24 is a bottom view of a plurality of iron club heads, specifically 2-iron club head through 7-iron club head.
Figure 25:
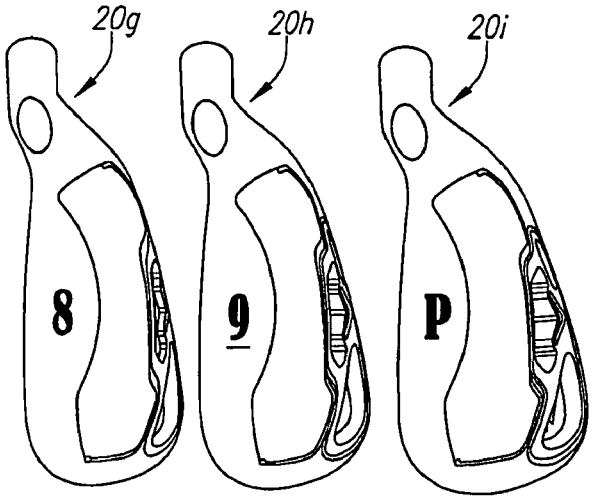
FIG. 25 is a bottom view of a plurality of iron club heads, specifically 8-iron club head through pitching wedge iron club head.
Figure 26:
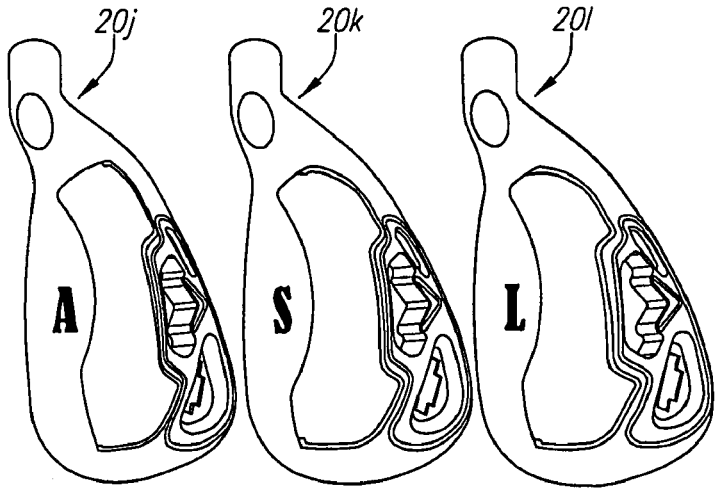
FIG. 26 is a bottom view of a plurality of iron club heads, specifically approach wedge iron club head through lob wedge iron club head.

As shown in FIGS. 22-26, the size and mass of the three main components of the golf club head 20 vary from 2-iron to lob wedge. FIG. 22 shows a 2-iron club head 20*a*. FIG. 23 shows a lob wedge iron club head 20L. Further, as shown in FIGS. 24-26, the sole width of the iron club heads 20*a*-20L, generally increases from the 2-iron club head 20*a* to the lob wedge iron club head 20L. Table One and Table Two further illustrate the difference in the set of iron club heads 20*a*-20L. The mass values in Table One are preferred values and are in grams. The volume values in Table Two are preferred values and are in cubic inches. In general, the masses and volumes of the main body 22 and the mass member 25 increase from the 2-iron club head to the lob wedge club head while the mass and volume of the central member 24 decreases from the 2-iron club head to the lob wedge club head.

TABLE ONE

| Club Head | Main Body Mass | Central Member Mass | Mass Member Mass | Total club head mass |
|---|---|---|---|---|
| 2 Iron | 150-155 | 30-35 | 35-40 | 225-235 |
| 3 Iron | 155-162 | 30-35 | 40-45 | 235-240 |
| 4 Iron | 155-160 | 30-35 | 45-50 | 240-245 |
| 5 Iron | 160-165 | 30-35 | 50-55 | 245-250 |
| 6 Iron | 165-170 | 25-30 | 55-60 | 255-260 |
| 7 Iron | 165-170 | 25-30 | 60-65 | 260-265 |
| 8 Iron | 170-175 | 20-25 | 65-70 | 265-270 |
| 9 Iron | 175-180 | 20-25 | 70-80 | 275-280 |
| Pitching wedge | 175-180 | 20-25 | 80-90 | 285-290 |
| Approach wedge | 185-190 | 15-20 | 75-85 | 285-290 |
| Sand wedge | 205-210 | 15-20 | 70-80 | 290-300 |
| Lob wedge | 210-215 | 5-10 | 70-80 | 290-300 |

TABLE TWO

| Club head | Loft | Lie | Main Body Volume | Mass Member Volume |
|---|---|---|---|---|
| 2 Iron | | | 2.109 | 0.256 |
| 3 Iron | 20 | 58.9 | 2.192 | 0.266 |
| 4 Iron | 22.0 | 59.6 | 2.157 | 0.326 |
| 5 Iron | 24 | 60.3 | 2.226 | 0.342 |
| 6 Iron | 27 | 61.0 | 2.301 | 0.372 |
| 7 Iron | 30 | 61.5 | 2.313 | 0.415 |
| 8 Iron | 34 | 62.5 | 2.363 | 0.458 |
| 9 Iron | 39 | 63.5 | 2.415 | 0.492 |
| Pitching wedge | 44 | 64.0 | 2.416 | 0.574 |
| Approach wedge | 50 | 64.0 | 2.595 | 0.52 |
| Sand wedge | 56 | 64.0 | 2.749 | 0.491 |
| Lob wedge | 60 | | 2.885 | 0.494 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. An iron golf club head comprising:

a main body composed of a titanium alloy material, the main body comprising a front wall, a sole wall, a toe wall extending upward from the sole wall at a first end of the sole wall, a hosel extending upward from the sole wall at a second end of the sole wall, a heel wall extending upward from the sole wall, a top wall extending from an upper end of the toe wall to an upper end of the heel wall, the top wall, the sole wall, the heel wall, the toe wall and the front wall defining a rear cavity, the sole wall having a recess located below the rear cavity, the recess extending from a bottom of the golf club head to a rear end of the golf club head, the main body having a mass ranging from 150 grams to 200 grams;

a central member disposed in the rear cavity of the main body, the central member being composed entirely of a non-metal material and having a body portion with an interior surface, an exterior surface, a sole surface, a top surface, a toe surface, and a heel surface, the central member preferably has a mass ranging from 15 grams to 40 grams; and a mass member disposed in the recess of the sole wall of the main body, the mass member extending from a bottom of the golf club head to the rear end of the golf club head, the mass member composed of a nickel-tungsten alloy comprising at least approximately 50 weight percent nickel and at least approximately 20 weight percent tungsten, the mass member having a density greater than each of the density of the first metal material of the main body and the non-metal material of the central member, the mass member having a mass ranging from 40 grams to 80 grams;

wherein the golf club head has a mass ranging from 235 grams to 300 grams;

wherein the golf club head has a moment of inertia Ixx through the center of gravity of at least 2600 g-cm$^2$ and a moment of inertia Izz through the center of gravity of at least 2400 g-cm$^2$ and wherein the mass member further comprises a projection extending upward, and the sole wall of the main body has an aperture extending from the rear cavity to the recess, wherein the projection of the mass member is inserted into the aperture of the sole wall of the main body.

2. The iron golf club head according to claim 1 further comprising a first medallion disposed in a recess of the central member and a second medallion disposed in a second recess of the central member.

3. The iron golf club head according to claim 1 wherein the nickel-tungsten alloy of the mass member further comprises at least 20 weight percent chromium.

4. The iron golf club head according to claim 1 wherein the front wall has a thickness ranging from 0.040 inch to 0.250 inch.

5. The iron golf club head according to claim 1 further comprising a medallion disposed within a recess of the exterior surface of the central member.

6. The iron golf club head according to claim 1 wherein the mass member has a density ranging from 9 g/cm$^3$ and 10.5 g/cm$^3$.

7. The iron golf club head according to claim 1 wherein the mass member has a volume percentage of the golf club head ranging from 5% to 25%, and a mass percentage of the golf club head ranging from 10% to 50%.

8. The iron golf club head according to claim 1 wherein the central member has a volume percentage of the golf club head ranging from 25% to 75%, and a mass percentage of the golf club head ranging from 10% to 30%.

9. The iron golf club head according to claim 1 wherein the sole wall has a width, Ws, ranging from 1.0 inches to 1.75 inches.

10. The iron club head according to claim 1 wherein the main body has a volume ranging from 50% to 75% of the iron-type club head and a mass ranging from 50% to 75% of the iron-type club head.

11. An iron golf club head comprising:

a main body member composed of a titanium alloy material having a density between 4 g/cm$^3$ and 9 g/cm$^3$, the main body comprising a front wall, a sole wall, a toe wall extending upward from the sole wall at a first end of the sole wall, a hosel extending upward from the sole wall at a second end of the sole wall, a heel wall extending upward from the sole wall, a top wall extending from an upper end of the toe wall to an upper end of the heel wall, the top wall, the sole wall, the heel wall, the toe wall and the front wall defining a rear cavity, the sole wall having a recess located below the rear cavity, the recess extending from a bottom of the golf club head to a rear end of the golf club head, the main body having a mass ranging from 150 grams to 200 grams;

a central member disposed in the rear cavity of the main body, the central member being composed entirely of a non-metal material and having a density less than 1.5 $g/cm^3$, the central member having a body portion with an interior surface, an exterior surface, a sole surface, a top surface, a toe surface, and a heel surface, the central member preferably has a mass ranging from 15 grams to 40 grams; and a mass member disposed in the recess of the sole wall of the main body, the mass member extending from a bottom of the golf club head to the rear end of the golf club head, the mass member composed of a nickel-tungsten alloy comprising at least approximately 50 weight percent nickel and at least approximately 20 weight percent tungsten, the mass member having a density greater than each of the density of the first metal material of the main body and the non-metal material of the central member, the mass member having a mass ranging from 40 grams to 80 grams;

wherein the golf club head has a mass ranging from 235 grams to 300 grams;

wherein the golf club head has a moment of inertia Ixx through the center of gravity of at least 2600 $g\text{-}cm^2$ and a moment of inertia Izz through the center of gravity of at least 2400 $g\text{-}cm^2$ and wherein the mass member further comprises a projection extending upward, and the sole wall of the main body has an aperture extending from the rear cavity to the recess, wherein the projection of the mass member is inserted into the aperture of the sole wall of the main body.

12. The iron golf club head according to claim 11 wherein the nickel-tungsten alloy further comprises at least 20 weight percent chromium.

* * * * *